US009164455B2

(12) United States Patent
Murayama

(10) Patent No.: US 9,164,455 B2
(45) Date of Patent: Oct. 20, 2015

(54) IMAGE FORMING APPARATUS

(75) Inventor: Kentaro Murayama, Kasugai (JP)

(73) Assignee: BROTHER KOGYO KABUSHIKI KAISHA, Nagoya-Shi, Aichi-Ken (JP)

( * ) Notice: Subject to any disclaimer, the term of this patent is extended or adjusted under 35 U.S.C. 154(b) by 472 days.

(21) Appl. No.: 13/333,489

(22) Filed: Dec. 21, 2011

(65) Prior Publication Data

US 2012/0163843 A1 Jun. 28, 2012

(30) Foreign Application Priority Data

Dec. 24, 2010 (JP) ..... 2010-287388

(51) Int. Cl.
*G03G 15/00* (2006.01)
*G03G 15/01* (2006.01)

(52) U.S. Cl.
CPC ..... *G03G 15/5058* (2013.01); *G03G 15/0194* (2013.01); *G03G 15/5033* (2013.01); *G03G 2215/00042* (2013.01); *G03G 2215/00059* (2013.01); *G03G 2215/00063* (2013.01); *G03G 2215/0119* (2013.01); *G03G 2215/0141* (2013.01); *G03G 2215/0161* (2013.01)

(58) Field of Classification Search
CPC ..... G03G 15/5033; G03G 2215/00042; G03G 2215/00059; G03G 2215/00063; G03G 2215/0119
USPC ..... 399/49, 59, 68, 397, 399
See application file for complete search history.

(56) References Cited

U.S. PATENT DOCUMENTS 5,245,396 A * 9/1993 Ohshima et al. ..... 399/301
6,198,896 B1 * 3/2001 Nakayasu et al. ..... 399/301
6,345,171 B1 * 2/2002 Suga ..... 399/396
6,493,533 B1 * 12/2002 Munakata ..... 399/301
6,934,498 B2 * 8/2005 Kobayashi et al. ..... 399/301
7,233,761 B2 * 6/2007 Kawagoe ..... 399/301
7,751,734 B2 * 7/2010 Mestha et al. ..... 399/49
7,907,880 B2 * 3/2011 Muroi ..... 399/301
7,965,967 B2 * 6/2011 Murayama ..... 399/301

(Continued)

FOREIGN PATENT DOCUMENTS

EP 2 328 036 A2 6/2011
JP H11-231586 A 8/1999

(Continued)

OTHER PUBLICATIONS

Japan Patent Office, Notification of Reasons for Refusal for Japanese Patent Application No. 2010-287388 (counterpart Japanese paten application), dispatched Jan. 29, 2013.

(Continued)

*Primary Examiner* — Clayton E Laballe
*Assistant Examiner* — Kevin Butler
(74) *Attorney, Agent, or Firm* — Merchant & Gould PC

(57) ABSTRACT

An image forming apparatus is provided. The image forming apparatus includes an image forming unit configured to form a mark, a conveyance member configured, to convey the mark, a sensor configured to read the mark conveyed by the conveyance member, a measurement unit configured to measure a moving time period between a time when the image forming unit forms the mark and a time when the mark conveyed by the conveyance member is read by the sensor, and a determination unit configured to determine whether a traveling speed of the conveyance member is appropriate based on the moving time period measured by the measurement unit.

18 Claims, 6 Drawing Sheets

(56) References Cited

U.S. PATENT DOCUMENTS

| | | | | |
|---|---|---|---|---|
| 8,023,871 | B2 * | 9/2011 | Murayama | 399/301 |
| 8,228,556 | B2 * | 7/2012 | Mestha et al. | 358/1.9 |
| 8,305,637 | B2 * | 11/2012 | Shinohara | 358/1.9 |
| 8,311,435 | B2 * | 11/2012 | Kushida | 399/72 |
| 8,355,159 | B2 * | 1/2013 | Dobbertin et al. | 358/1.4 |
| 2006/0093410 | A1 | 5/2006 | Hata | |
| 2006/0140685 | A1 * | 6/2006 | Muroi | 399/301 |
| 2007/0014595 | A1 * | 1/2007 | Kawagoe | 399/301 |
| 2007/0109393 | A1 * | 5/2007 | Tomita et al. | 347/232 |
| 2007/0217831 | A1 * | 9/2007 | Maeda | 399/301 |
| 2007/0237533 | A1 | 10/2007 | Hanashi et al. | |
| 2008/0031649 | A1 | 2/2008 | Dan | |
| 2008/0075492 | A1 * | 3/2008 | Mestha et al. | 399/49 |
| 2008/0124114 | A1 | 5/2008 | Yamagata et al. | |
| 2009/0162111 | A1 * | 6/2009 | Murayama | 399/301 |
| 2009/0162112 | A1 * | 6/2009 | Murayama | 399/301 |
| 2010/0296128 | A1 * | 11/2010 | Young et al. | 358/409 |
| 2011/0128559 | A1 | 6/2011 | Yamada | |
| 2011/0182602 | A1 * | 7/2011 | Suzuki | 399/49 |
| 2012/0163842 | A1 | 6/2012 | Murayama | |
| 2012/0163843 | A1 * | 6/2012 | Murayama | 399/49 |
| 2012/0224891 | A1 * | 9/2012 | Byun et al. | 399/301 |
| 2012/0251135 | A1 * | 10/2012 | Murayama | 399/27 |
| 2012/0251142 | A1 * | 10/2012 | Okano | 399/49 |

FOREIGN PATENT DOCUMENTS

| | | | |
|---|---|---|---|
| JP | 2003-223034 | A | 8/2003 |
| JP | 2004-053669 | A | 2/2004 |
| JP | 2004-069909 | A | 3/2004 |
| JP | 2004-117386 | A | 4/2004 |
| JP | 2004-309687 | A | 11/2004 |
| JP | 2005-309050 | A | 11/2005 |
| JP | 2005-338673 | A | 12/2005 |
| JP | 2006-126654 | A | 5/2006 |
| JP | 2006-178374 | A | 7/2006 |
| JP | 2007-279523 | A | 10/2007 |
| JP | 2008-039905 | A | 2/2008 |
| JP | 2008-134333 | A | 6/2008 |
| JP | 2008-158459 | A | 7/2008 |
| JP | 2008-304735 | A | 12/2008 |

OTHER PUBLICATIONS

European Patent Office, European Search Report for European Patent Application No. 11194278.5 (counterpart to above-captioned patent application), dated Apr. 20, 2012.

Japan Patent Office, Notification of Reasons for Refusal for Japanese Patent Application No. 2010-287388 (counterpart to above-captioned patent application), mailed Jun. 11, 2013.

* cited by examiner

IMAGE FORMING APPARATUS

CROSS-REFERENCE TO RELATED APPLICATION

This application claims priority from Japanese Patent Application No. 2010-287388, filed on Dec. 24, 2010, the entire subject matter of which is incorporated herein by reference.

TECHNICAL FIELD

Aspects of the present invention relate to an image forming apparatus, and particularly, to an image forming apparatus having a conveyance member that conveys an image.

BACKGROUND

There has been known an image forming apparatus which has a conveyance member that carries and conveys a sheet or an image, such as a sheet conveyance belt that conveys a sheet toward an image forming part (for example, which is an image transfer unit for an electro-photographic type or an ink ejection unit for an inkjet type) or an image conveyance belt that conveys an image transferred from an image forming unit. According to the image forming apparatus, in order to perform a high quality printing, it is necessary to control a traveling speed of the conveyance member to be a target speed.

For example, JP 2006-178374A describes an image forming apparatus which employs a technique of controlling the traveling speed of a sheet conveyance belt to be constant. Specifically, in the image forming apparatus, in order to adjust the traveling speed of the sheet conveyance belt, marks provided on the sheet conveyance belt are read and feedback control is performed so that a detection interval of the marks becomes constant. Thereby, the traveling speed of the sheet conveyance belt is controlled to be a target speed.

However, that image forming apparatus has the following problems. That is, according to that image forming apparatus, in order to determine whether the traveling speed of the sheet conveyance belt is appropriate, it is necessary to read the marks for traveling speed detection, which are provided in advance at end portions of the sheet conveyance belt in the width direction, and to detect a time interval between the adjacent marks. However, when there is a scratch or foreign material in any of the adjacent marks, the time interval cannot be accurately measured. Therefore, it is possible to erroneously determine whether the traveling speed is appropriate or whether the traveling speed is appropriate cannot be determined, so that the reliability is rather low.

SUMMARY

Accordingly, it is an aspect of the present invention to provide an image forming apparatus having high reliability of determining whether a traveling speed of a conveyance member is appropriate.

According to an illustrative embodiment of the present invention, there is provided an image forming apparatus comprising: an image forming unit configured to form a mark; a conveyance member configured to convey the mark; a sensor configured to read the mark conveyed by the conveyance member; a measurement unit configured to measure a moving time period between a time when the image forming unit forms the mark and a time when the mark conveyed by the conveyance member is read by the sensor; and a determination unit configured to determine whether a traveling speed of the conveyance member is appropriate based on the moving time period measured by the measurement unit.

BRIEF DESCRIPTION OF THE DRAWINGS

The above and other aspects of the present invention will become more apparent and more readily appreciated from the following description of illustrative embodiments of the present invention taken in conjunction with the attached drawings, in which.

DETAILED DESCRIPTION

Hereinafter, an image forming apparatus and an image forming system according to illustrative embodiments of the present invention will be specifically described with reference to the accompanying drawings. In the illustrative embodiments, a multi-function peripheral (MFP) is an example of the image forming apparatus and has a color printing function.

[Configuration of MFP]

Figure 1:
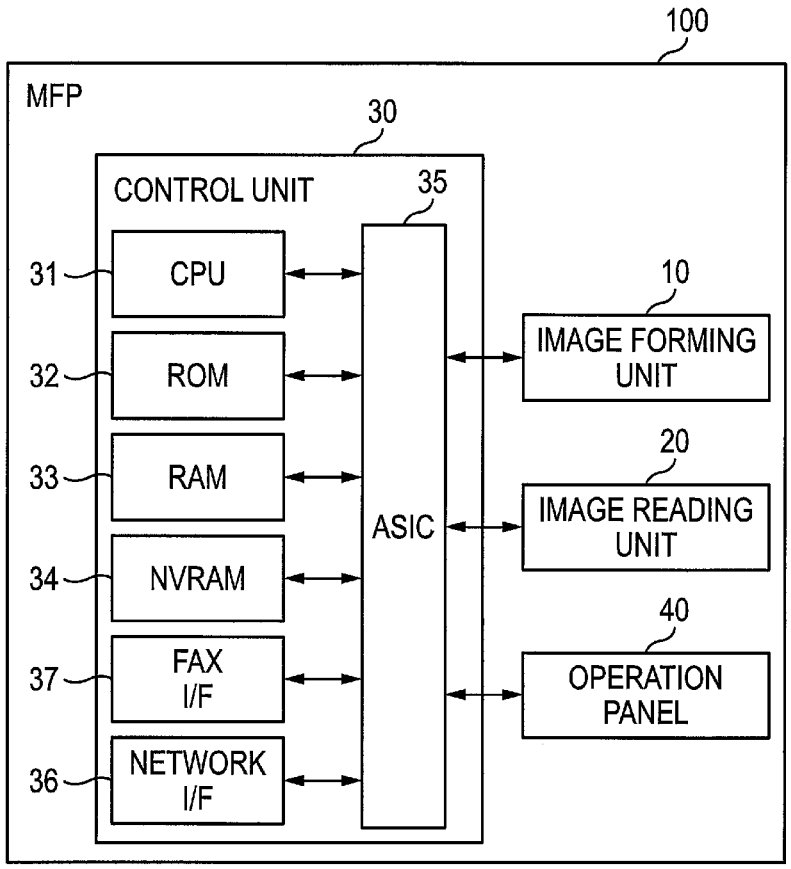
FIG. 1 is a block diagram showing an electrical configuration of an MFP.

As shown in FIG. 1, an MFP 100 of this illustrative embodiment includes a control unit 30 having a CPU 31, a ROM 32, a RAM 33, an NVRAM (non-volatile RAM) 34, an ASIC 35, a network interface 36 and a FAX interface 37. In addition, the control unit 30 is electrically connected to an image forming unit 10 that forms an image on a sheet, an image reading unit 20 that reads an image of a document and an operation panel 40 that displays an operation status and receives an input operation by a user.

The CPU 31 (an example of the measurement unit, the determination unit, the change unit and the adjustment unit) executes operations for implementing various functions such as an image reading function, an image forming function, a FAX data transmission/reception function and a belt speed adjustment function that will be described later, in the MFP 100, and is a center of control. The ROM 32 stores therein various control programs for controlling the MFP 100, various settings, initial values and the like. The RAM 33 is used as a work area from which the various control programs are read out or a storage area that temporarily stores image data. The NVRAM 34 is a non-volatile storage means and is used, as a storage area that preserves various settings, image data and the like.

Based on the control programs read from the ROM 32 or signals transmitted from various sensors, the CPU 31 controls the respective elements of the MFP 100 (for example, controls a turn-on timing of an exposure device configuring the image forming unit 10, driving motors of various rollers configuring a conveyance path of a sheet) through the ASIC 35 while storing results of the processing in the RAM 33 or NVRAM 34.

The network interface 36 is connected to a network and enables connection with the other information processing apparatuses. The FAX interface 37 is connected to a telephone line and enables connection with a FAX apparatus of another party. In the meantime, it is possible to perform data communication with an external apparatus through the network interface 36 or FAX interface 37.

[Configuration of Image Forming Unit of MFP]

Figure 2:
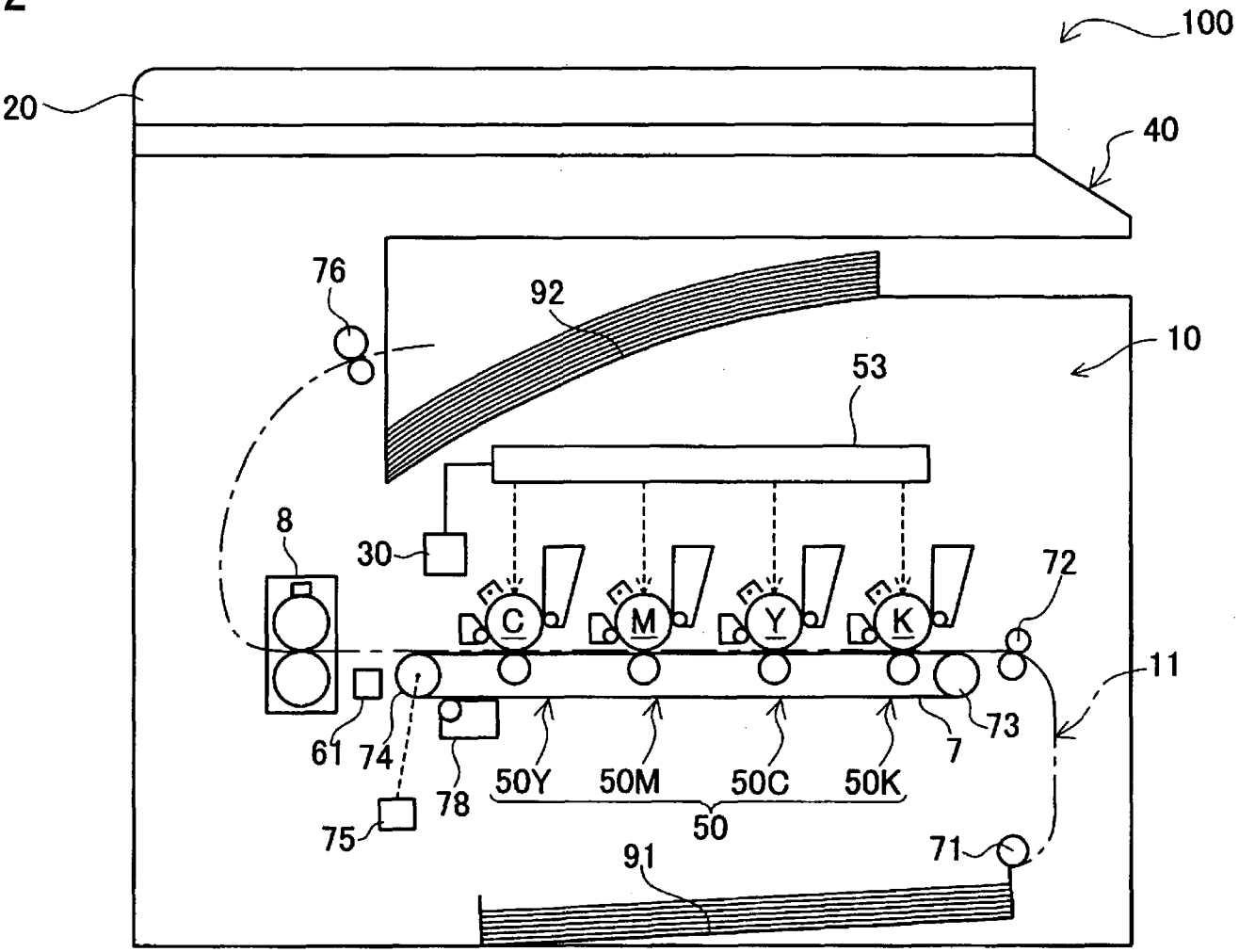
FIG. 2 shows a schematic configuration of an image forming unit of the MFP shown in FIG. 1.

Next, a configuration of the image forming unit 10 of the MFP 100 is described with reference to FIG. 2. The image forming unit 10 has a process unit 50 that forms a toner image by an electro-photographic method and transfers the toner image on a sheet, a fixing device 8 that fixes unfixed toner on the sheet, a sheet feeding tray 91 that stores therein sheets before image transfer and a sheet discharge tray 92 that receives thereon the sheets after the image transfer. The image reading unit 20 is provided above the image forming unit 10.

The image forming unit 10 has an exposure device 53 that illuminates light to respective process units 50Y, 50M, 50C, 50K, a conveyance belt 7 that conveys a sheet toward transfer positions of the respective process units 50Y, 50M, 50C, 50K and a mark sensor 61 that detects a mark formed on the conveyance belt 7.

The image forming unit 10 has a conveyance path 11 (dashed-dotted line in FIG. 2) having a substantially S-shape so that the sheet stored in the sheet feeding tray 91 provided at a bottom passes through a feeder roller 71, registration rollers 72, the process unit 50 and the fixing device 8 and is then guided to the sheet discharge tray 92 through sheet discharge rollers 76.

The process unit 50 can form a color image and have the process units corresponding to respective colors of yellow (Y), magenta (M), cyan (C) and black (K) arranged in parallel. Specifically, the process unit 50 has the process unit 50C that forms an image of C color, the process unit 50M that forms an image of M color, the process unit 50Y that forms an image of Y color, and the process unit 50K that forms an image of K color. The respective process units 50C, 50M, 50Y, 50K are arranged at a predetermined interval in the conveyance direction of the sheet.

Figure 3:
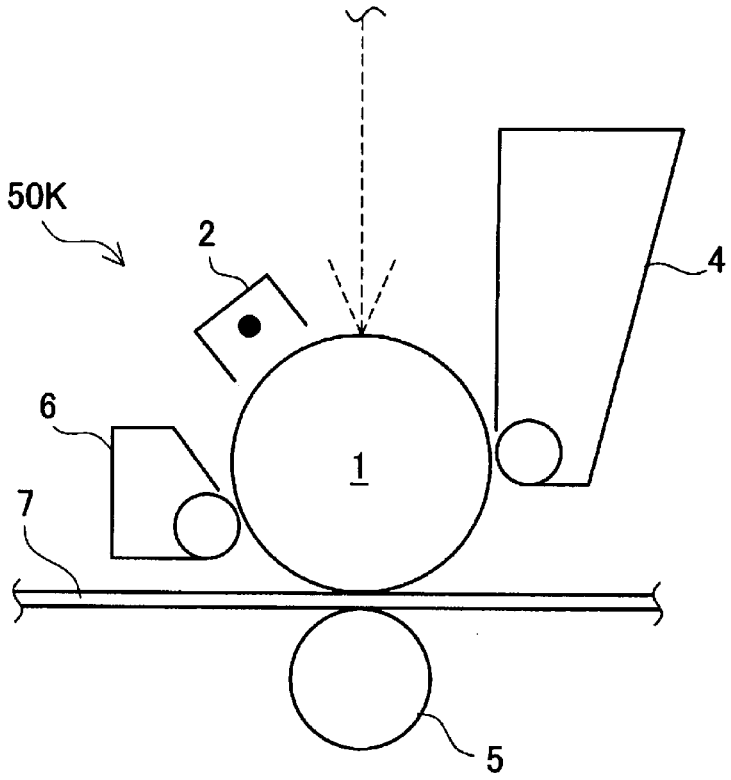
FIG. 3 shows a schematic configuration of a process unit of the MFP shown in FIG. 2.

FIG. 3 shows a configuration of the process unit 50K. The process unit 50K has a photosensitive member 1 (an example of the conveyance member) having a dram shape, a charging device 2 that uniformly charges a surface of the photosensitive member 1, a developing device 4 that develops an electrostatic latent image by toner, a transfer device 5 that transfers a toner image on the photosensitive member 1 to the sheet and a cleaner 6 that electrically collects the toner (transfer remaining toner) remaining on the photosensitive member 1 after the transfer from the surface of the photosensitive member 1. The photosensitive member 1 and the transfer device 5 are arranged to contact the conveyance belt 7. The photosensitive member 1 opposes the transfer device 5 with the conveyance belt 7 being interposed therebetween. The process units 50C, 50M, 50Y have the same configuration as that of the process unit 50K.

In each of the respective process units 50C, 50M, 50Y, 50K, the surface of the photosensitive member 1 is uniformly charged by the charging devices 2. Thereafter, the photosensitive member 1 is exposed by light from the exposure device 53, so that an electrostatic latent image of an image to be formed on the sheet is formed thereon. Then, toner is supplied to the photosensitive member 1 through the developing device 4. Thereby, the electrostatic latent image on the photosensitive member 1 becomes a visible image as a toner image.

The image forming unit 10 picks up a sheet stored, in the sheet feeding tray 91 one by one and conveys the sheet onto the conveyance belt 7. Then, the image forming unit 10 transfers the toner image formed in the process unit 50 onto the sheet. At this time, for a case of a color printing, toner images are formed by the respective process units 50Y, 50M, 50C, 50K and are then overlapped on the sheet. In the meantime, for a case of a black-and-white printing, a toner image is formed only by the process unit 50K and is then transferred onto the sheet. Thereafter, the sheet on which the toner images are transferred is conveyed toward the fixing device 8, and the toner images are then heat-fixed on the sheet. Then, the sheet after the fixing is discharged to the sheet discharge tray 92.

The conveyance belt 7 (an example of the conveyance member) is an endless belt that is wound around conveyance rollers 73, 74 and is made of resin material such as polycarbonate and the like. The conveyance roller 73 on which the conveyance belt 7 is wound is urged in a direction of separating away from the conveyance roller 74. Thereby, the conveyance belt 7 tightly extends over the conveyance roller 73 and the conveyance roller 74. It is noted that the conveyance belt 7 may be stretched by thermal expansion. When the conveyance belt 7 is stretched, the conveyance belt 7 is stretched in the more upstream side from the process unit 50 by the conveyance roller 73 that is urged in the direction of separating away from the conveyance roller 74.

The conveyance roller 74 is a driving roller that is driven by a driving motor 75. As the conveyance roller 74 is rotated, the conveyance belt 7 is rotated in a counterclockwise direction. Thereby, the sheet that is put on the conveyance belt is conveyed from the registration rollers 72 toward the fixing device 8. The conveyance roller 73 is rotated as the conveyance belt 7 is moved.

The mark sensor 61 is provided downstream from the process units 50Y, 50M, 50C, 50K and upstream from the fixing device 8 with respect to the conveyance direction of the sheet. The mark sensor 61 detects marks that are formed by the process units 50C, 50M, 50Y, 50K and are transferred onto the conveyance belt 7.

Figure 4:
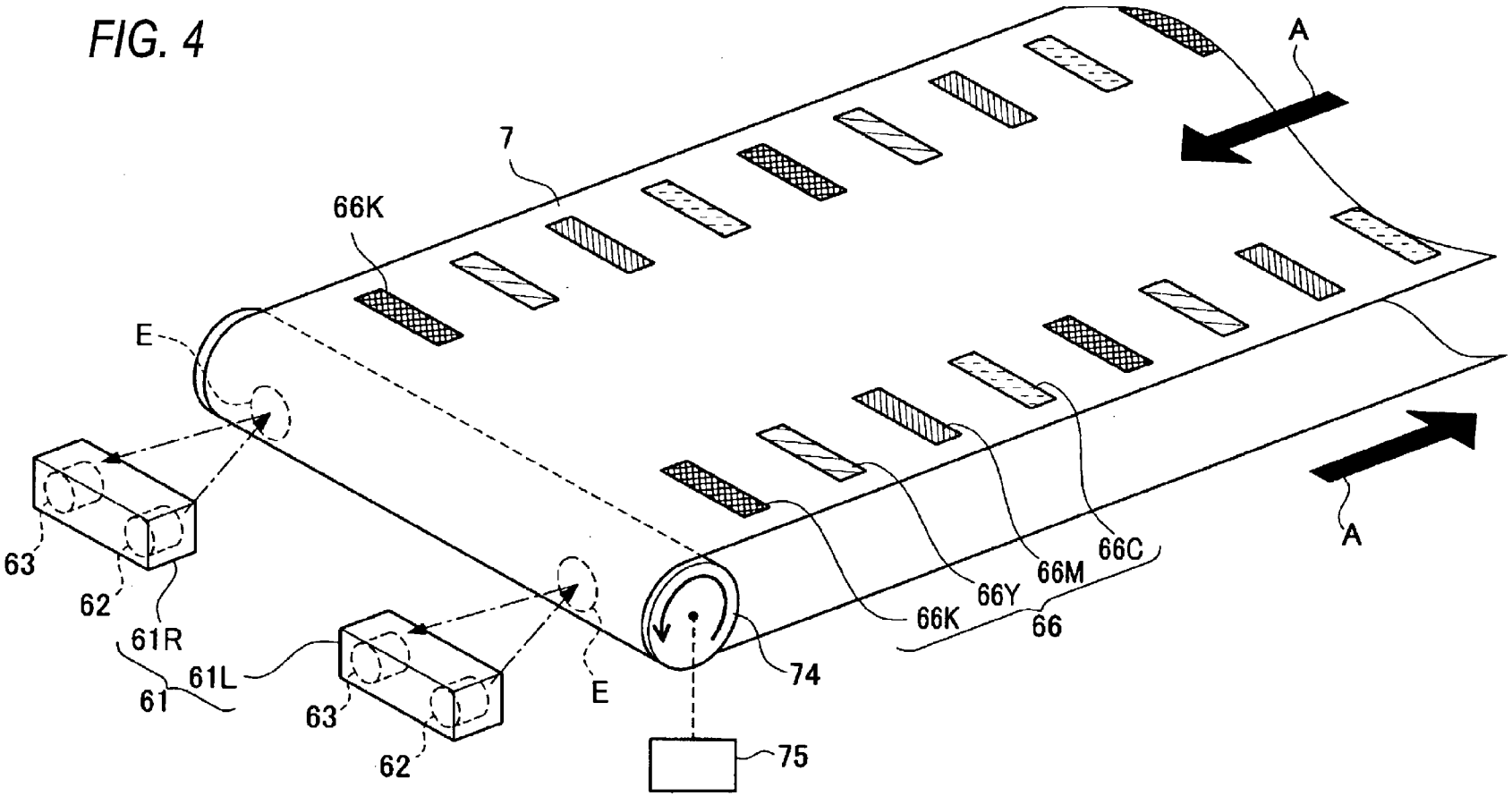
FIG. 4 shows an arrangement of mark sensors and an example of speed detection marks.

Specifically, as shown in FIG. 4, the mark sensor 61 includes two sensors, i.e., a sensor 61R that is arranged at a right side of the conveyance belt 7 in a width direction and a sensor 61L that is arranged at a left side thereof. Each of the sensors 61R, 61L is a reflection-type optical sensor having a pair of a light emitting device 62 (for example, LED) and a light receiving device 63 (for example, photo transistor). The mark sensor 61 illuminates light onto the surface (dotted ranges E in FIG. 4) of the conveyance belt 7 in an oblique direction by the light emitting devices 62 and receives the light by the light receiving devices 63, respectively.

The marks 66 are formed by the respective process units 50C, 50M, 50Y, 50K and transferred onto the conveyance belt 7. As the conveyance belt 7 is rotated, the marks are conveyed in an arrow A direction of FIG. 4. The mark sensor 61 detects the mark by a difference between an amount of received light when the mark 66 passes and an amount of received light that is directly received from the conveyance belt 7.

As shown in FIG. 4, the marks 66 are respectively formed by the process units 50C, 50M, 50Y, 50K. Specifically, the mark that is formed by the process unit 50K is referred to as the mark 66K, the mark that is formed by the process unit 50C is referred to as the mark 66C, the mark that is formed by the process unit 50M is referred to as the mark 66M, and the mark that is formed by the process unit 50Y is referred to as the mark 66Y. The marks 66K, 66C, 66M, 66Y are formed at the same time and transferred at the same time. Accordingly, the intervals of the marks 66K-66C-66M-66Y are the substantially same as those of the transfer positions of the process units 50C-50M-50Y-50K.

In addition, the respective marks 66K, 66C, 66M, 66Y are formed in plural. An image forming timing is adjusted so that the marks are not overlapped with each other when transferring the marks onto the conveyance belt 7. That is, the marks 66 are formed at a constant interval in the sub-scanning direction (moving direction of the conveyance belt 7 shown in FIG. 4).

In this illustrative embodiment, the respective marks 66K, 66C, 66M, 66Y have a rectangular rod shape and are respectively arranged in parallel with the main scanning direction (direction orthogonal to the sub-scanning direction, width direction of the conveyance belt 7). For example, by detecting the mark 66K by the mark sensor 61, there can be measured the time period (moving time period) between a time when the mark 66K is formed by the developing unit 60K and a time when the mark 66K is detected by the mark sensor 61. Since the mark 66 is dedicated mark for measuring the moving time period, the mark 66 can be simple while considering reduction of toner consumption.

Figure 5:
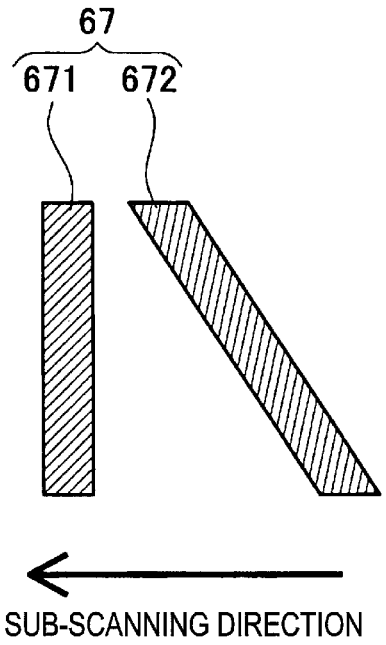
FIG. 5 shows an example of a registration pattern for positional deviation adjustment.

In the meantime, the mark that is detected by the mark sensor 61 is not limited to the mark 66 for traveling speed measurement. For example, the mark sensor 61 also reads a registration pattern that is a mark for positional deviation adjustment. For example, as shown in FIG. 5, the registration pattern 67 includes a pair of rod-shaped marks in which one mark 671 is parallel with the main scanning direction and the other mark 672 is inclined with respect to the main scanning direction. In the registration pattern 67, a degree of positional deviation in the main scanning direction is specified by time period between a detection timing of the mark 671 to a detection timing of the mark 672 and a degree of positional deviation in the sub-scanning direction is specified by non-uniformity of the time from the detection timing of the mark 671 to the detection timing of the mark 672.

Figure 6:
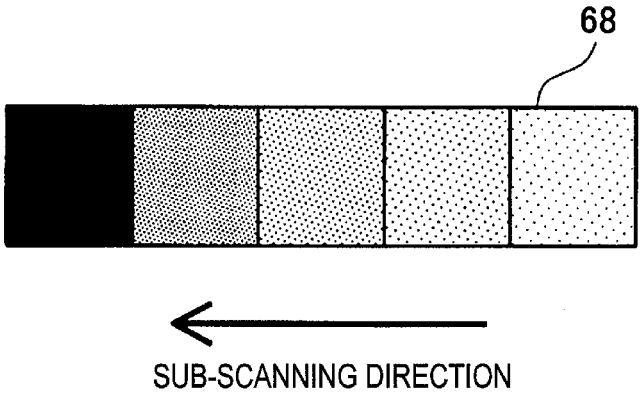
FIG. 6 shows an example of a density pattern for density deviation adjustment.

In addition, the mark sensor 61 may also read a density pattern that is a mark for density deviation adjustment. For example, as shown in FIG. 6, the density pattern 68 has an image pattern in which a density difference is provided in the sub-scanning direction. Then, amounts of reflected light from the density pattern 68 are detected. Based on the amount of reflected light, a density is specified.

Also, a waste toner box 78 for collecting the toner attached on the conveyance belt 7 is provided to contact the conveyance belt 7. The waste toner box 78 collects the transfer remaining toners discharged from the cleaners 6 of the respective process units 50C, 50M, 50Y, 50K and the mark 66 having passed to the measurement position E of the mark sensor 61.

[Belt Speed Adjustment Process]

Figure 7:
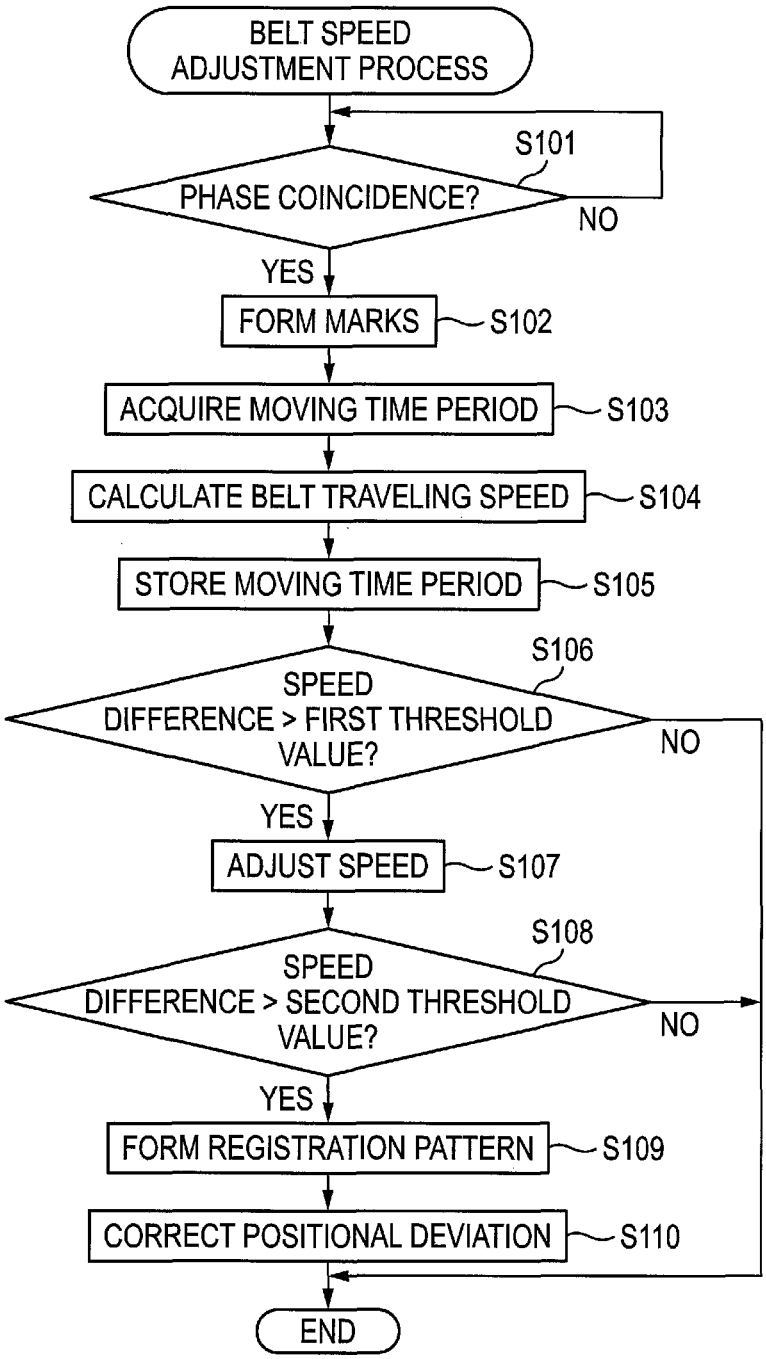
FIG. 7 is a flowchart showing a sequence of a belt speed adjustment process.

In the below, a belt speed adjustment process of acquiring a speed of the conveyance belt 7 and adjusting the speed (if necessary) is described with reference to a flowchart of FIG. 7. The belt speed adjustment process is executed by the CPU 31 when a predetermined condition is satisfied. The predetermined condition may include, for example, when a power supply turns on, when the printed number of sheets from previous adjustment process reaches a threshold value or larger, when a change of temperatures from previous adjustment process is a threshold, value or higher, when elapsed time from previous adjustment process is a threshold value or greater, when a user inputs an instruction, and the like.

In the belt speed adjustment process, it is determined whether phases of the photosensitive member 1 and the conveyance belt 7 coincide with each other (S101). The rotating member such as the photosensitive member 1, the conveyance belt 7 or driving roller 74 of the conveyance belt 7 has periodic speed non-uniformity due to eccentricity, seams and the like. Accordingly, in order to suppress the influence of the speed non-uniformity, the measurement is preferably made at similar conditions as much as possible. Hence, when the phases of the photosensitive member 1 and the conveyance belt 7 do not coincide with each other (S101: NO), the process stands by until the phases coincide. Regarding the phase, there are three phases i.e. the phase of the conveyance belt 7, the phase of the driving roller 74 and both phases and any phase may be adopted in the determination of S101.

When the phases of the photosensitive member 1 and the conveyance belt 7 coincide with each other (S101: YES), the process units 50C, 50M, 50Y, 50K respectively form the marks 66C, 66M, 66Y, 66K at the same time(Si02). Thereafter, the marks 66C, 66M, 66Y, 66K are transferred onto the conveyance belt 7 at the same time and are conveyed as the conveyance belt 7 is rotated.

After S102, the mark sensor 61 detects the passing of the respective marks 66C, 66M, 66Y, 66K, so that the time period (moving time period) between a time of the image formations of the respective marks 66C, 66M, 66Y, 66K and a time of the mark detections (S103).

Then, based on the moving time period acquired in S103, the traveling speed of the conveyance belt 7 is calculated (S104). Specifically, the traveling speed is calculated as explained below.

First, distances are defined as follows.

LC: distance from a transfer position of the process unit 50C to a reading position of the mark sensor 61.

LM: distance from a transfer position of the process unit 50M to a reading position of the mark sensor 61.

LY: distance from a transfer position of the process unit 50Y to a reading position of the mark sensor 61.

LK: distance from a transfer position of the process unit 50K to a reading position of the mark sensor 61.

LC, LM, LY and LK are design values and are stored in the ROM 32. In this illustrative embodiment, there are arranged in order of the processing units 50K, 50Y, 50M, 50C from the upstream side of the sheet conveyance direction, so that the relationship is LC<LM<LY<LK.

The moving time period is defined as follows. In the meantime, when a plurality of the marks 66 is formed for one color, an average value is calculated.

T1C: moving time period, of mark 66C.

T1M: moving time period of mark 66M.

T1Y: moving time period of mark 66Y.

T1K: moving time period of mark 66K.

T1C, T1M, T1Y and T1K are values measured in S103. In this illustrative embodiment, the time of image formation, which is a starting time of the moving time period, is the time of exposure. However, the time of image formation is not limited to the time of exposure and may be time of developing or time of transfer.

T2C: time period from an exposure position of the process unit 50C to a transfer position.

T2M: time period from an exposure position of the process unit 50M to a transfer position.

T2Y: time period from, an exposure position of the process unit 50Y to a transfer position.

T2K: time period, from an exposure position of the process unit 50K to a transfer position.

T2C, T2M, T2Y and T2K are respectively calculated from an angle from an exposure position to a transfer position and an angular velocity of the photosensitive member 1. As the angle and the angular velocity are used, the above time periods are not influenced by a change of a drum diameter due to the temperature change.

T3C: time period (T1C-T2C) from a transfer position of the process unit 50C to a reading position of the mark sensor 61.

T3M: time period (T1M-T2M) from a transfer position of the process unit 50M to a reading position of the mark sensor 61.

T3Y: time period (T1Y-T2Y) from a transfer position of the process unit 50Y to a reading position of the mark sensor 61.

T3K; time period (T1K-T2K) from a transfer position of the process unit 50K to a reading position of the mark sensor 61.

Based on the above values, the traveling speed of the conveyance belt 7, which is calculated for a single mark of each color, is as follows (calculation method 1).

V1C: LC/T3C

V1M: LM/T3M

V1Y: LY/T3Y

V1K: LK/T3K

It is noted that since it is possible to calculate the traveling speed by a single mark in the calculation of the traveling speed by the calculation method 1, it is not necessary to calculate the traveling speeds for all the four colors, and therefore, the mark may be formed by at least one color. However, the traveling speed calculated in the calculation method 1 is more influenced by an error as the moving distance is shorter. Accordingly, in the calculation method 1, it is preferable to calculate the traveling speed V1K, in which the moving distance to the mark sensor 61 is longest. That is, when it is intended to acquire the traveling speed of the conveyance belt 7 by the calculation method 1, at least the mark 66K is formed by the process unit 50K.

In addition, the traveling speed of the conveyance belt 7, which is calculated based on the moving time period of marks of plural colors, is as follows (calculation method 2).

$$V2=(V1C+V1M+V1Y+V1K)/4.$$

In the calculation method 2, since the marks of four colors are used, it is also possible to calculate color deviation in the sub-scanning direction at the same time with the traveling speed by measuring a detection interval between the marks of respective colors.

Alternatively, the traveling speed of the conveyance belt 7, which is calculated based on the moving time period of marks of respective colors, is as follows (calculation method 3).

$$V3=\{4\times(T3C\times LC+T3M\times LM+T3Y\times LY+T3K\times LK)-(T3C+T3M+T3Y+T3K)\times(LC+LM+LY+LK)\}/\{4\times(T3C^2+T3M^2+T3Y^2+T3K^2)-(T3C+T3M+T3Y+T3K)^2\}$$

The calculation method 3 calculates the traveling speed by the least square method. In the calculation method 3, the calculation processes are increased, compared to the calculation method 2. However, the calculation method 3 has high precision and tolerance to the error. Also, since the marks of four colors are used, like the calculation method 2, it is also possible to calculate the color deviation in the sub-scanning direction at the same time with the traveling speed.

After calculating the traveling speed in S104, the moving time period T1C, T1M, T1Y, T1K of the respective marks are stored in the NVRAM 34 (S105). Then, it is determined whether a speed difference between a reference speed V0 which is pre-stored in the ROM 32 and the traveling speed which is stored at this time is a first threshold value or greater (S106).

It is noted that the reference speed V0 of the traveling speed of the conveyance belt 7 is a traveling speed that is obtained by performing a test of the traveling speed of the conveyance belt 7 under environments within a predetermined temperature range before the shipment. The reference speed can be acquired in the same sequence as S101 to S104. That is, the reference speed that is used in S106 is a value that is individually set for each image forming apparatus.

When the speed difference is smaller than the first threshold value (S016: NO), it is determined that the traveling speed is within an appropriate range and it is not necessary to adjust the speed. Accordingly, the belt speed adjustment process ends without adjusting the speed.

On the other hand, when the speed difference is the first threshold value or greater (S106: YES), the traveling speed is beyond the appropriate range and it is thus necessary to adjust the speed. Therefore, the angular velocity of the driving motor 75 of the conveyance roller 74 is controlled to adjust the speed of the conveyance belt 7 by feedback control so that the traveling speed approaches the reference speed V0 (S107).

Then, it is determined whether a speed difference between the traveling speed stored at previous time and the traveling speed stored at this time is a second threshold value or larger (S108). The second threshold value is larger than the first threshold value. In S108, it is determined whether the speed difference is considerably increased. When the speed difference is smaller than the second threshold value (S108: NO), the belt speed adjustment process ends.

On the other hand, when the speed difference is the second threshold value or larger (S108: YES), this means that the speed difference is remarkably large. Thus, it is expected that the color deviation occurs by a cause different from the traveling speed of the conveyance belt 7. Accordingly, the registration pattern 67 shown in FIG. 5 is formed (S109) and the registration pattern 67 is detected by the mark sensor 61, thereby performing a positional deviation correction (S110). After S110, the belt speed adjustment process ends.

Specifically, in S110, a degree of color deviation is calculated and the exposure timing is adjusted based on the degree of color deviation. The degree of color deviation and the adjustment amount are calculated as explained below, for example. First, distances between the developing units and weight values are defined as follows.

LKC: distance between transfer positions of the process unit 50K and the process unit 50C.

LKM: distance between transfer positions of the process unit 50K and the process unit 50M.

LKY; distance between transfer positions of the process unit 50K and the process unit 50Y.

$$\alpha=LKC/LC$$

$$\beta=LKM/LM$$

$$\gamma=LKY/LY$$

LKC, LKM, LKY, α, β and γ are design values and are stored in the ROM 32.

In addition, a moving time period difference ΔT between a value of previous time and a value of this time is calculated as follows.

T0: moving time period measured at previous time (which is stored in the NVROM 34).

T1: moving time period measured at this time.

T2: moving time period from an exposure position to a transfer position.

T3: value of the previous time (T0−T2) of the time period from a transfer position to a reading position of the mark sensor 61.

T4: value of this time (T1−T2) of the time period from a transfer position to a reading position of the mark sensor 61.

ΔT: difference (T4−T3) between a value of previous time and a value of this time.

An assumed degree of color deviation and an adjustment amount of reducing the color deviation are as follows.

V0: design value of the traveling speed of the conveyance belt 7 (which is stored in the ROM 32).

degree of color deviation between K and C: $V0\times\Delta T\times\alpha$ degree of color deviation between K and M: $V0\times\Delta T\times\beta$ degree of color deviation between K and Y: $V0\times\Delta T\times\gamma$ adjustment amount of exposure timing between K and C=$\Delta T\times\alpha$ adjustment amount of exposure timing between K and M=$\Delta T\times\beta$ adjustment amount of exposure timing between K and Y=$\Delta T\times\gamma$ As described above, in the MFP 100 according to the present illustrative embodiment, when acquiring the traveling speed of the conveyance belt 7, the respective process units 50C, 50M, 50Y, 50K form the marks 66C, 66M, 66Y, 66K and the moving time period by the mark sensor 61 reads the respective marks is measured. Then, the traveling speed of the conveyance belt 7 is acquired based on the moving time period of the individual marks and it is determined whether the traveling speed is appropriate. That is, the determination target (traveling speed in this illustrative embodiment) is acquired from the measurement result of a single mark 66, which means that the determination target is not acquired from measurement results of a plurality of marks, as in the related art. Accordingly, compared to the related art, there is a low possibility that an erroneous determination or determination impossibility will occur and the reliability of determining whether the traveling speed of the conveyance belt 7 is appropriate improves.

In this illustrative embodiment, the traveling speed is acquired based on the moving time period of the single mark, regardless of the detection interval of the adjacent marks. Furthermore, even when the conveyance belt 7 is stretched, due to the thermal expansion, the moving distance of the mark is not changed. Accordingly, the reliability improves because the traveling speed is not influenced well by the stretching of the conveyance belt 7 accompanied with the temperature change.

While the present invention has been shown and described with reference to certain illustrative embodiments thereof, it will be understood by those skilled in the art that various changes in form and details may be made therein without departing from the spirit and scope of the invention as defined by the appended claims.

For example, the image forming apparatus is not limited to the MFP and the inventive concept of the present invention may be applied any image forming apparatus having a printing function such as printer, copier and FAX apparatus. In addition, the image forming apparatus is not limited to the electro-photographic type and an inkjet method may be employed. For example, for the inkjet type, the time at which ink is ejected may be the measurement start time of the moving time period. Further, the MFP 100 of the illustrative embodiment is a direct transfer tandem type. The inventive concept of the present invention may be also applied to an intermediate transfer type or four-cycle type.

In the above illustrative embodiment, the MFP having the color printing function is described. However, the image forming apparatus is not limited to the color printing apparatus. For example, the inventive concept of the present invention may be also applied to a black-and-white printing apparatus having only one process unit.

In the above illustrative embodiment, each of all the process units forms a plurality the marks 66 for speed measurement and the moving time period of each mark is measured to calculate the traveling speed of the conveyance belt 7. However, the present invention is not limited thereto. For example, the respective process units may form a single mark 66. Alternatively, one process unit may form a plurality of marks 66. Also, one process unit may form a single mark 66. By reducing the number of the marks 66, it is possible to suppress the consumption of the toner. On the other hand, by increasing the number of the marks 66, it is possible to improve the accuracy of the moving time period to be measured.

In the above illustrative embodiment, when acquiring the traveling speed, the marks 66 are formed by all the process units 50C, 50M, 50Y, 50K. However, as described above, some of the process units may form the marks. In this case, the longer the moving time period of the mark, the considerable error of the moving time period appears. Thereby, it is possible to easily determine whether the traveling speed is appropriate. Accordingly, it is preferable to form the mark 66K by the process unit 50K, which has the longest mark moving distance.

In the above illustrative embodiment, the mark 66 is formed in condition that the phases between the photosensitive member 1 and the conveyance belt 7 coincide with each other. However, the present invention is not limited thereto. For example, the mark 66 may be formed in condition that the phases between the photosensitive member 1 and the driving roller 74 of the conveyance belt 7 coincide with each other. Also, it is not necessarily required to match the phases of the two rotating members. For example, the same phase may be used so as to initiate the mark formation at the same position for one of the photosensitive member 1, the conveyance belt 7 and the driving roller 74 of the conveyance belt 7, so that it is possible to suppress the influence on the speed non-uniformity of the corresponding rotating member.

In the above illustrative embodiment, after the traveling speed of the conveyance belt 7 is calculated, it is directly determined whether the traveling speed is appropriate. That is, since the moving distance of the mark is fixed, it may be possible to indirectly determine whether the traveling speed is appropriate by determining whether the moving time period of the mark is appropriate.

In the above illustrative embodiment, when the current traveling speed of the conveyance belt 7 is beyond the appropriate range, the speed of the driving roller 74 of the conveyance belt 7 is adjusted. However, the present invention is not limited thereto. For example, it may be possible to stop the moving of the conveyance belt 7 as determining that an error occurs. Also, it may be possible to adjust the exposure timing to the current traveling time of the conveyance belt 7.

In the above illustrative embodiment, the speed difference between the traveling speed and the reference speed. V0 that is the traveling speed at the shipment time is calculated. However, the present invention is not limited thereto. For example, it may be possible that a speed difference between the traveling speed measured at previous time and the current traveling speed is calculated and it is determined whether the speed difference is the first threshold value or larger.

In the above illustrative embodiment, the mark sensor 61 detects the mark 66 for traveling speed measurement and the registration pattern 67 for positional deviation (color deviation) adjustment and reads the density pattern 68 for density deviation adjustment. However, dedicated sensors may be respectively provided. In the meantime, the mark sensor 61 has the function of reading the plurality of types of marks, like the above illustrative embodiment, so that it is possible to reduce the number of sensors.

In the above illustrative embodiment, the marks 66 for traveling speed, measurement are formed at both ends of the conveyance belt 7. However, the marks may be formed only at one end portion.

In the above illustrative embodiment, the CPU 31 performs the belt speed adjustment process or the like. However, the present invention is not limited thereto and a plurality of CPUs or a special ASIC may perform the belt speed adjustment process or the like.

What is claimed is:

1. An image forming apparatus comprising:

an image forming unit including a rotary member configured to form a mark;

a conveyance member including an endless conveyance belt configured to convey the mark;

a sensor configured to read the mark conveyed by the conveyance belt; and a control device configured to perform:

a phase determining process of determining whether a rotation phase of the rotary member and a rotation phase of the conveyance belt coincide with each other;

an instructing process of instructing the image forming unit to form the mark when the phase determining process determines that the rotation phase of the rotary member and the rotation phase of the conveyance belt coincide with each other;

a reading process of causing the sensor to read the mark which is formed by the image forming unit based on the instructing process and conveyed by the conveyance member;

a measuring process of measuring a time period from a time when the image forming unit forms the mark based on the instructing process to a time when the sensor reads, in the reading process, the mark, which is formed by the image forming unit based on the instructing process and conveyed by the conveyance member; and a determining process of determining whether a traveling speed of the conveyance member is appropriate based on the time period measured in the measuring process.

2. The image forming apparatus according to claim 1, wherein a plurality of image forming units are provided, and wherein the instructing process instructs at least one of the image forming units, for which the time period is to be longest, to form the mark.

3. The image forming apparatus according to claim 1, wherein a plurality of the image forming units are provided, wherein the instructing process instructs at least two of the image forming units to form marks, respectively, and wherein the determining process determines whether the traveling speed of the conveyance member is appropriate based on a plurality of time periods measured for the respective marks.

4. The image forming apparatus according to claim 3, wherein the instructing process instructs the at least two of the image forming units to form the marks at the same time.

5. The image forming apparatus according to claim 1, wherein the determining process uses a determination criterion for determining whether the traveling speed of the conveyance member is appropriate, and wherein the determination criterion is a value that IS set for each Image forming apparatus.

6. The Image forming apparatus according to claim 1, wherein the control device is further configured to perform:

a changing process of changing the traveling speed of the conveyance member when it is determined that the traveling speed of the conveyance member is not appropriate.

7. The Image forming apparatus according to claim 1, wherein the control device is further configured to perform:

a positional deviation adjustment when it is determined that the traveling speed of the conveyance member is not appropriate.

8. The image forming apparatus according to claim 1, wherein the reading process further causes the sensor to read a mark, which is formed by the image forming unit and is an adjustment image for at least one of positional deviation and density deviation.

9. An image forming apparatus comprising:

an image forming unit configured to form a mark;

a conveyance member configured to convey the mark;

a sensor configured to read the mark conveyed by the conveyance member; and a control device configured to perform:

an instructing process of instructing the image forming unit to form the mark;

a reading process of causing the sensor to read the mark which is formed by the image forming unit based on the instructing process and conveyed by the conveyance member;

a measuring process of measuring a time period from a time when the image forming unit forms the mark based on the instructing process to a time when the sensor reads, in the reading process, the mark which is formed by the image forming unit based on the instructing process and conveyed by the conveyance member; and a determining process of determining whether a traveling speed of the conveyance member is appropriate based on the time period measured in the measuring process, wherein the mark is a dedicated mark for measuring the time period and is different from a mark for positional deviation adjustment and a mark for density deviation adjustment.

10. An image forming apparatus comprising:

a plurality of image forming units configured to form marks, respectively;

a conveyance member configured to convey the marks;

a sensor configured to read the marks conveyed by the conveyance member; and a control device configured to perform:

an instructing process of instructing one of the image forming units, which is provided furthest from the sensor, to form the mark;

a reading process of causing the sensor to read the mark which is formed by the one of the image forming units based on the instructing process and conveyed by the conveyance member;

a measuring process of measuring a time period from a time when the one of the image forming units forms the mark based on the instructing process to a time when the sensor reads, in the reading process, the mark which is formed by one of the image forming units based on the instructing process and conveyed by the conveyance member; and a changing process of changing a traveling speed of the conveyance member based on the time period measured in the measuring process.

11. An image forming apparatus comprising:

an image forming unit including a rotary member configured to form a mark;

a conveyance member including a driving roller and an endless conveyance belt which is driven by the driving roller and configured to convey the mark;

a sensor configured to read the mark conveyed by the conveyance belt; and a control device configured to perform:

a phase determining process of determining whether a rotation phase of the rotary member and a rotation phase of the driving roller coincide with each other;

an instructing process of instructing the image forming unit to form the mark when the phase determining process determines that the rotation phase of the rotary member and the rotation phase of the driving roller coincide with each other;

a reading process of causing the sensor to read the mark which is formed by the image forming unit based on the instructing process and conveyed by the conveyance member;

a measuring process of measuring a time period from a time when the image forming unit forms the mark based on the instructing process to a time when the sensor reads, in the reading process, the mark which is formed by the image forming unit based on the instructing process and conveyed by the conveyance member; and a determining process of determining whether a traveling speed of the conveyance member is appropriate based on the time period measured in the measuring process.

12. The image forming apparatus according to claim 11, wherein a plurality of image forming units are provided, and wherein the instructing process instructs at least one of the image forming units, for which the time period is to be longest, to form the mark.

13. The image forming apparatus according to claim 11, wherein a plurality of the image forming units are provided, wherein the instructing process instructs at least two of the image forming units to form marks, respectively, and wherein the determining process determines whether the traveling speed of the conveyance member is appropriate based on a plurality of time periods measured for the respective marks.

14. The image forming apparatus according to claim 13, wherein the instructing process instructs the at least two of the image forming units to form the marks at the same time.

15. The image forming apparatus according to claim 11, wherein the determining process uses a determination criterion for determining whether the traveling speed of the conveyance member is appropriate, and wherein the determination criterion is a value that is set for each image forming apparatus.

16. The image forming apparatus according to claim 11, wherein the control device is further configured to perform:

a changing process of changing the traveling speed of the conveyance member when it is determined that the traveling speed of the conveyance member is not appropriate.

17. The image forming apparatus according to claim 11, wherein the control device is further configured to perform:

a positional deviation adjustment when it is determined that the traveling speed of the conveyance member is not appropriate.

18. The image forming apparatus according to claim 11, wherein the reading process further causes the sensor to read a mark, which is formed by the image forming unit and is an adjustment image for at least one of positional deviation and density deviation.

* * * * *